US010265553B2

(12) United States Patent
Boss et al.

(10) Patent No.: US 10,265,553 B2
(45) Date of Patent: Apr. 23, 2019

(54) PROTECTIVE HOOD

(71) Applicant: MSA EUROPE GMBH, Jona (CH)

(72) Inventors: Juergen Boss, Berlin (DE); Peter Kadow, Berlin (DE); Peter Kling, Berlin (DE)

(73) Assignee: MSA EUROPE GMBH, Jona (CH)

( * ) Notice: Subject to any disclaimer, the term of this patent is extended or adjusted under 35 U.S.C. 154(b) by 210 days.

(21) Appl. No.: 14/423,365

(22) PCT Filed: Mar. 14, 2013

(86) PCT No.: PCT/EP2013/055292
§ 371 (c)(1),
(2) Date: Feb. 23, 2015

(87) PCT Pub. No.: WO2014/029511
PCT Pub. Date: Feb. 27, 2014

(65) Prior Publication Data

US 2015/0202471 A1 Jul. 23, 2015

(30) Foreign Application Priority Data

Aug. 24, 2012 (DE) ..... 10 2012 215 116

(51) Int. Cl.
*A62B 17/04* (2006.01)
*A62B 17/00* (2006.01)
(Continued)

(52) U.S. Cl.
CPC ..... *A62B 17/04* (2013.01); *A62B 7/00* (2013.01); *A62B 9/022* (2013.01); *A62B 9/04* (2013.01); *A62B 17/001* (2013.01)

(58) Field of Classification Search
CPC ..... A62B 17/00; A62B 17/001; A62B 17/04; A62B 18/00; A62B 18/02; A62B 18/04;
(Continued)

(56) References Cited

U.S. PATENT DOCUMENTS 312,471 A * 2/1885 Holden ..... A01K 55/00 2/4
2,821,192 A * 1/1958 Monro ..... A62B 18/02 128/201.15
(Continued)

FOREIGN PATENT DOCUMENTS

CN 1486207 A 3/2004
CN 2629756 Y 8/2004
(Continued)

OTHER PUBLICATIONS

International Search Authority, Search Report for International Application PCT/EP2013/055292, dated Apr. 17, 2014, 2 pages, Rijswijk, NL.
(Continued)

*Primary Examiner* — (Jackie) Tan-Uyen T Ho
*Assistant Examiner* — Joseph D Boecker
(74) *Attorney, Agent, or Firm* — The Webb Law Firm

(57) ABSTRACT

Described is a breathing system that covers a person's head with a flexible hood material. One aspect provides a protective hood, including: a flexible hood material having a closed top portion and a neck portion; a viewing window disposed within the flexible hood material; a breathing inlet disposed in the flexible hood material and providing for breathing air to enter into an interior of the protective hood; an exhalation valve disposed interior to the protective hood; and a sealing arrangement disposed at the neck portion of the flexible hood material; wherein at least a portion of expelled gas from the exhalation valve is released into an interior of the protective hood and rinses the interior of the protective hood.

18 Claims, 9 Drawing Sheets

(51) Int. Cl.
*A62B 7/00* (2006.01)
*A62B 9/02* (2006.01)
*A62B 9/04* (2006.01)

(58) Field of Classification Search
CPC ..... A62B 18/06; A62B 18/084; A62B 18/10; A62B 7/00; A62B 9/00; A62B 9/02; A62B 9/04; A42B 3/28–3/288
See application file for complete search history.

(56) References Cited

U.S. PATENT DOCUMENTS 3,423,763 A * 1/1969 Schwartz ..... A42B 1/046 2/171
3,433,222 A * 3/1969 Pinto ..... B63C 11/12 128/201.24
3,688,314 A * 9/1972 Hill ..... A62B 18/04 128/201.24
4,146,025 A * 3/1979 Warncke ..... A62B 27/00 128/201.23
4,231,359 A * 11/1980 Martin ..... A61M 16/06 128/201.18
4,250,876 A * 2/1981 Kranz ..... A62B 9/027 128/202.22
4,573,217 A 3/1986 Reed
4,619,254 A * 10/1986 Moretti ..... A62B 17/04 128/201.23
4,637,383 A 1/1987 Lopez
4,771,771 A 9/1988 Walther
4,836,197 A 6/1989 Rohling et al.
5,038,776 A * 8/1991 Harrison ..... A62B 18/084 128/201.23
5,056,512 A * 10/1991 Bower ..... A62B 17/04 128/201.25
5,095,550 A * 3/1992 Perlinger ..... A42B 3/105 2/410
5,133,344 A * 7/1992 Jurrius ..... A62B 17/04 128/201.23
5,140,980 A 8/1992 Haughey et al.
5,431,156 A 7/1995 Sundstrom
5,526,804 A * 6/1996 Ottestad ..... A62B 7/02 128/201.22
5,549,104 A * 8/1996 Crump ..... A62B 18/04 128/201.25
5,690,095 A * 11/1997 Glynn ..... A62B 17/04 128/201.23
5,819,728 A * 10/1998 Ritchie ..... A62B 17/04 128/201.23
5,996,580 A * 12/1999 Swann ..... A62B 23/02 128/204.18
6,023,787 A 2/2000 French et al.
6,340,024 B1 1/2002 Brookman et al.
6,371,110 B1 * 4/2002 Peterson ..... A62B 18/084 128/202.27
6,450,165 B1 9/2002 Silver et al.
6,460,538 B1 * 10/2002 Kemp ..... A62B 17/04 128/201.22
6,701,925 B1 3/2004 Resnick
6,775,850 B1 8/2004 Grilliot et al.
6,862,745 B2 3/2005 Grilliot et al.
6,892,725 B2 5/2005 Frund
6,918,141 B2 * 7/2005 Green ..... A41D 13/1153 128/201.23
7,028,687 B1 4/2006 Silver et al.
7,028,688 B1 * 4/2006 Grove ..... A62B 18/006 128/201.22
7,152,600 B2 12/2006 Freriks et al.
7,168,102 B1 * 1/2007 Holmquist ..... A62B 17/04 128/201.23
8,302,599 B2 * 11/2012 Green ..... A41D 13/1184 128/201.22
2004/0216736 A1 * 11/2004 Lee ..... A62B 17/04 128/201.22
2005/0115567 A1 * 6/2005 Bridges ..... A62B 18/04 128/206.21
2006/0102177 A1 5/2006 Lewis et al.
2006/0143795 A1 * 7/2006 London ..... A42B 1/201 2/202
2006/0201511 A1 * 9/2006 Freriks ..... A62B 17/04 128/205.29
2006/0289004 A1 * 12/2006 Saez ..... A62B 23/02 128/201.24
2009/0144884 A1 * 6/2009 Duncan ..... A42B 1/008 2/410
2010/0065058 A1 * 3/2010 Ungar ..... A62B 18/02 128/206.24
2011/0011404 A1 * 1/2011 Forbes ..... A62B 17/04 128/206.15
2011/0226240 A1 * 9/2011 Navalesi ..... A61M 16/06 128/201.23
2011/0277768 A1 * 11/2011 Hill ..... A62B 7/10 128/205.28
2014/0034049 A1 * 2/2014 Castiglione ..... A62B 9/04 128/202.27

FOREIGN PATENT DOCUMENTS

CN 2635357 Y 8/2004
CN 101001672 A 7/2007
GB 2211098 A * 6/1989 ..... A62B 17/04
GB 2247396 A 3/1992
GB 2301039 A 11/1996
GB 2430159 A 3/2007

OTHER PUBLICATIONS

International Preliminary Report on Patentability, Application PCT/EP2013/055292, dated Sep. 15, 2014, 10 pages, Rijswijk, NL.

* cited by examiner

PROTECTIVE HOOD

CLAIM FOR PRIORITY

This application claims priority to German Patent Application No. 10 2012 215 116.8, filed on Aug. 24, 2012, which is incorporated by reference in its entirety herein.

TECHNICAL FIELD

The subject matter described herein generally involves a protective hood.

BACKGROUND

Protective clothing is needed for people who work in harsh environments, for example environments that are short on oxygen and/or have contaminated breathing air. Contamination of the breathing air can result from various causes, such as through smoky air due to fires, through poisonous chemical substances, through biological pathogens, and/or through harmful particles, in particular radioactive particles. In such cases protection of the head is of special significance.

BRIEF SUMMARY

Generally, one embodiment provides a protective hood to cover a person's head with a flexible hood material, such as one made of textile, characterized by a breathing mask device (1) connected to or connectable with the protective hood (100) for the person (20) and an exhalation valve (3) of the breathing mask device (1), so arranged inside the protective hood (100) that during use the inside of the protective hood (100) is rinsable by the exhalation air.

Another embodiment provides a protective hood, comprising: a flexible hood material having a closed top portion and a neck portion; a viewing window disposed within the flexible hood material; a breathing inlet disposed in the flexible hood material and providing for a breathing air inlet into an interior of the protective hood; an exhalation valve disposed interior to the protective hood; and a sealing arrangement (which may also be termed sealing mechanism, sealing means, sealing method or sealing) disposed at the neck portion of the flexible hood material; wherein at least a portion of expelled gas from the exhalation valve is released into an interior of the protective hood and rinses the interior of the protective hood.

A further embodiment provides a breathing system, comprising: a protective hood (which may also be termed breathing hood) including a flexible hood material having a closed top portion and a neck portion; a viewing window disposed within the flexible hood material; a breathing inlet disposed in the flexible hood material and providing for a breathing air inlet into an interior of the protective hood; an exhalation valve disposed interior to the flexible hood material; a sealing arrangement disposed at the neck portion of the flexible hood material; and an automatic lung machine attached to the protective hood; wherein at least a portion of expelled gas from the exhalation valve is released into an interior of the protective hood and rinses the interior of the protective hood.

A yet further embodiment provides a method, comprising: fixing a viewing window and a breathing inlet into a flexible hood material of a protective hood, the flexible hood material having a closed top portion and a neck portion; providing an exhalation valve, wherein the exhalation valve is disposed within the protective hood such that gas expelled from the exhalation valve releases into an interior of the protective hood; and providing a sealing arrangement in the neck portion of the flexible hood material, the sealing arrangement being adjustable to allow sealing the interior of the protective hood off from an external environment.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
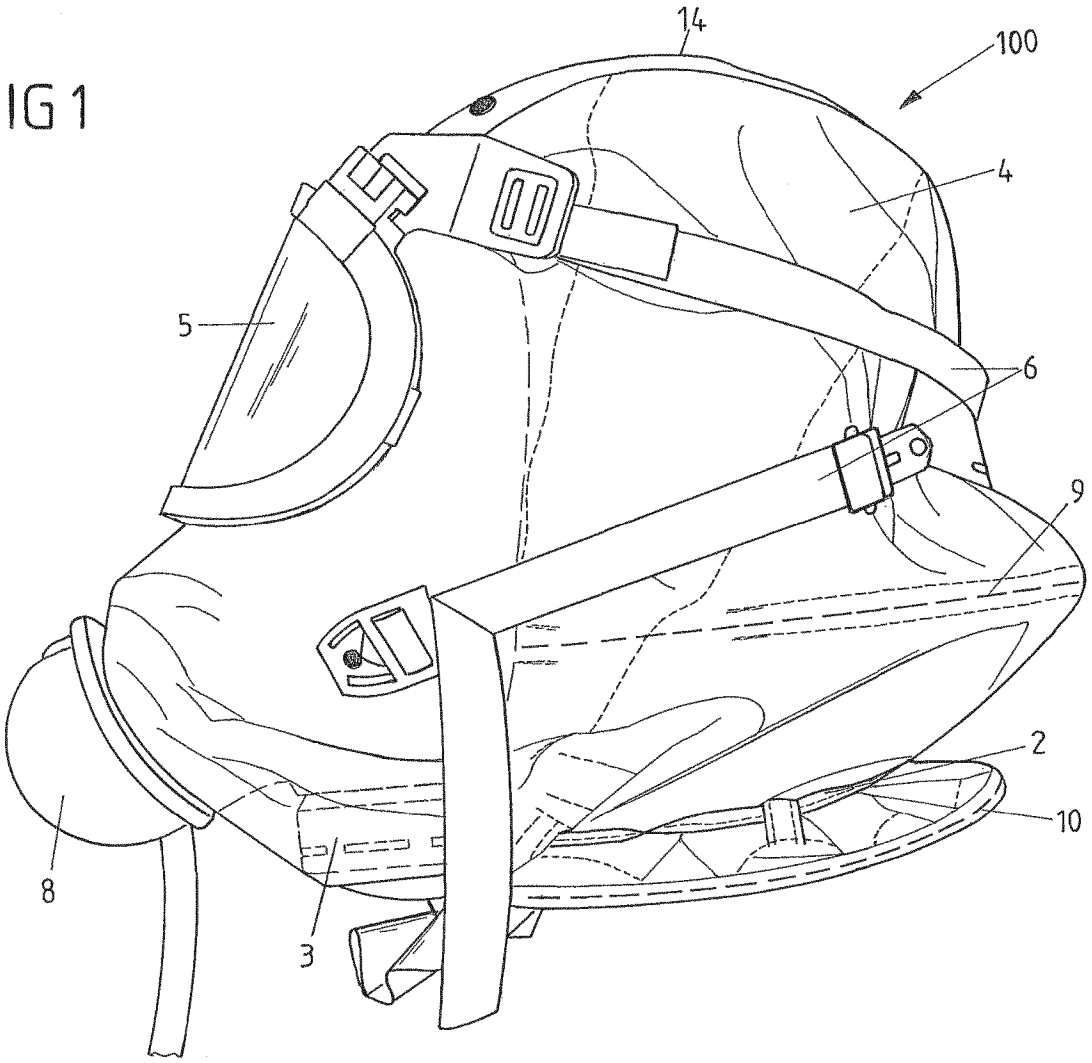
FIG. 1 illustrates a side view of an example embodiment of a protective hood.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of certain example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of certain embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Generally, the embodiments provide a protective hood that has a breathing mask device, which is connected to or connectable with the protective hood. In an embodiment, the protective hood has an exhalation valve set up on the inside of the protective hood. The exhalation valve, when in operation, allows the inside of the protective hood to be rinsed by the exhaled air that comes out of the exhalation valve. Thereby it is particularly difficult for particles to penetrate into the protective hood since such particles must move against the flow of the exhalation air.

In an embodiment, the protective hood has a sealing mechanism that serves to seal off the protective hood against the environment, whereby the sealing means, during use of the protective hood, is set up in the area of the person's neck. In an embodiment, an exhalation valve of the breathing mask device is set up within flexible hood material so that when the protective hood is in operation, the exhalation air rinses the interior of the protective hood. Additionally or in the alternative, positive pressure can be created within the protective hood due to the air coming out of the exhalation valve. For example, the exhalation air is not directed directly into the environment, but instead setting a slight positive pressure fulfills an expelling function within the protective hood. The creation of positive pressure may lie in the area between 0.1 and 5 mbar, in particular between 0.5 and 3 mbar. Alternatively or additionally, it is possible that the sealing arrangement has the function of a throttling valve.

In one possible embodiment, the breathing mask device is set up as a full mask, and a viewing window of the full mask is attached to or attachable to the flexible hood material. Thereby the breathing function and the protective function are integrated through the protective hood.

In one alternative embodiment, the protective hood has a connector for an automatic lung machine. Thereby the protective hood can be connected to a compressed air supply.

In another embodiment, on the outside at least one fastening device is set up. For example, a headband may be provided as a fastening device for fixing the protective hood and/or breathing mask device to the person's head. Through the fastening device, it is possible to adjust the seating of the protective hood and/or of the breathing mask device after putting it on, if, for example, the seat has been displaced during use.

For easy handling in putting on the protective hood, there are embodiments with stabilizer(s) for the flexible hood material. In one example, the flexible hood material is a textile material. In such an embodiment, at least one stabilizer is set up in the rear area of the head and/or of the person's neck. The stabilizer gives a certain form to the protective hood when in use so that in particular a donning area is kept free for ease of putting on the protective hood. By a certain stretching of the flexible hood material, small air reservoirs are also created on the interior of the protective hood. In this way, for example, an essentially arc-shaped, and in particular a U-shaped, first stabilizer can be used, whereby during use the back side of the person's head is set up within the arc-like first stabilizer (that is, on the concave side).

Additionally or alternatively, an essentially arc-shaped (and in particular a U-shaped) second stabilizer can be used, whereby the person's neck is set on the arc-shaped second stabilizer (that is, on the concave side). Thus, the arc-shaped stabilizers protect the rear of the head and the backside of the neck during use. The stabilizers fulfill other tasks such as keeping a donning area open.

The first and second stabilizers can essentially be set up in parallel, horizontal to each other, and the sealing arrangement is set up for sealing in the neck area between the two stabilizers. Thus, at least one stabilizer sets up an open donning area for placing the protective hood on the head before it is put on. The at least one stabilizers may have an elastic steel spring element, a plastic element, and/or a charcoal fiber element. These materials are flexible enough to permit a certain distortion and are stable enough to protect the head. To save space in storage, the flexible protective material can be folded together with the stabilizers and the sealing arrangement.

With the exhalation valve, and in particular the automatic lung machine, set up on the inside of the protective hood and above a sealing means, during operations the interior of the protective hood is rinsed by the exhalation air.

The illustrated example embodiments will be best understood by reference to the figures. The following description is intended only by way of example, and simply illustrates certain example embodiments.

Various example embodiments of a protective hood are shown as examples in the drawings. In these, in FIG. 1, a side view is presented of a protective hood 100, which can cover a person's head 20 and neck 21 (see, for example, FIG. 4). FIG. 1 shows a protective hood 100 in an operating position, whereby the person himself is not shown.

The protective hood 100 in a rough subdivision has a hood area with flexible hood material 4 and a breathing mask device 1, which in the illustrated example embodiment is integrated with the protective hood 100. This involves a hood-mask combination with a full mask (e.g., Class 3, EN 136). The hood material 4 is here made of a textile, in particular a coated textile material. The hood material can in this case be set up to be fire resistant, especially self-extinguishing, flexible when cold, easy to put on, washable, and outfitted with a warning color. In alternative embodiments, not illustrated here, the breathing mask device 1 and the hood material 4 are separate from each other.

Figure 2:
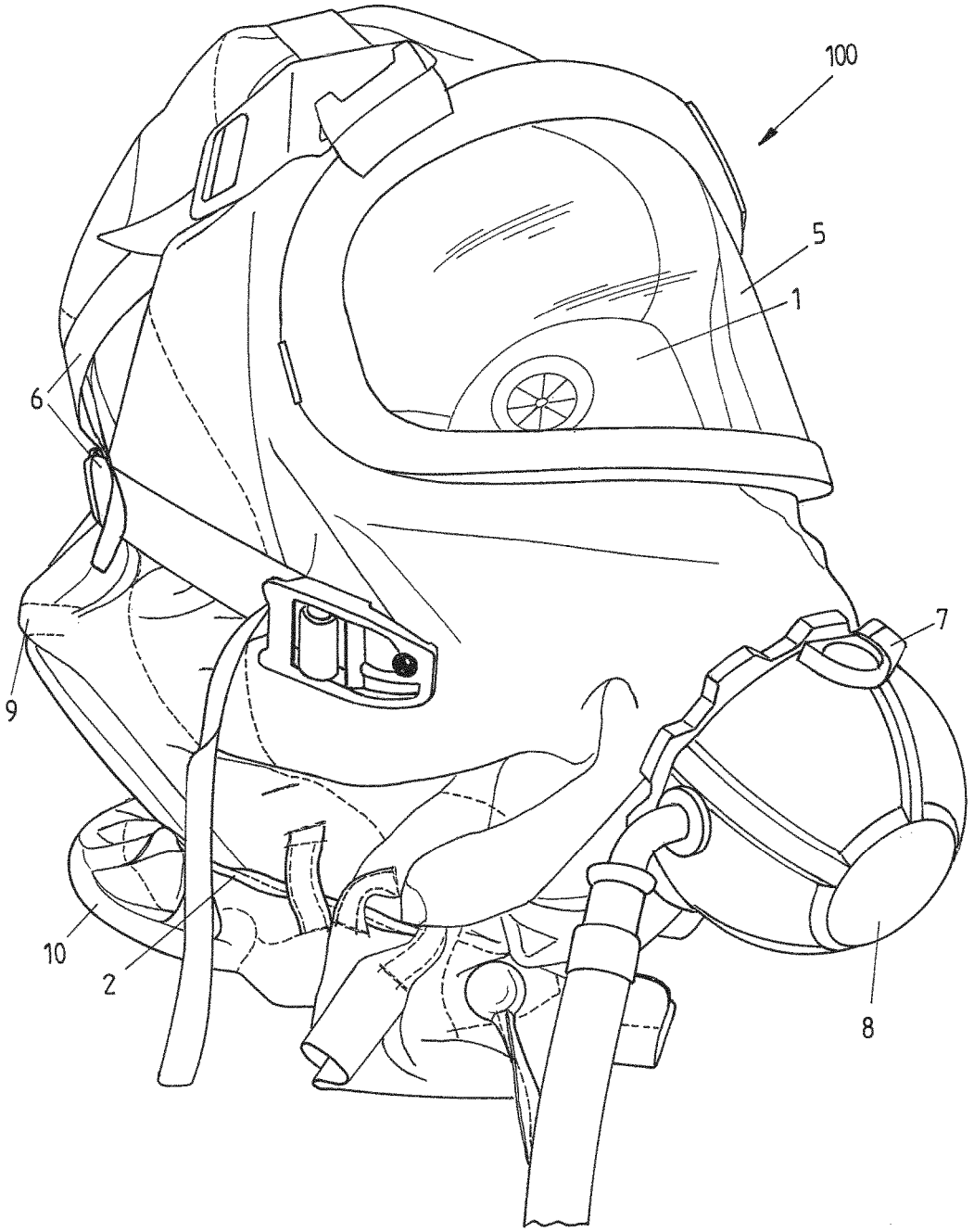
FIG. 2 illustrates a perspective view of the example embodiment according to FIG. 1.

In FIG. 1 the breathing mask device 1 is not shown but is discernible only through the viewing window 5 (see, e.g., FIG. 2). Additional example details are given in connection with the other figures. The exhalation valve 3 is presented schematically in FIG. 1. The exhalation valve 3 is set up inside the flexible hood material 4.

From the outside, an automatic lung machine 8 such as a pressure demand regulator is visible, which is connected to the breathing mask device 1 and provides breathing air from a supply of breathing air such as an air tank (not illustrated here). The automatic lung machine 8 is connected by a connector 7 (see FIG. 2) with the protective hood 100. In an alternative embodiment, the automatic lung machine 8 can be set up inside the protective hood 100 (see FIG. 9).

Figure 8:
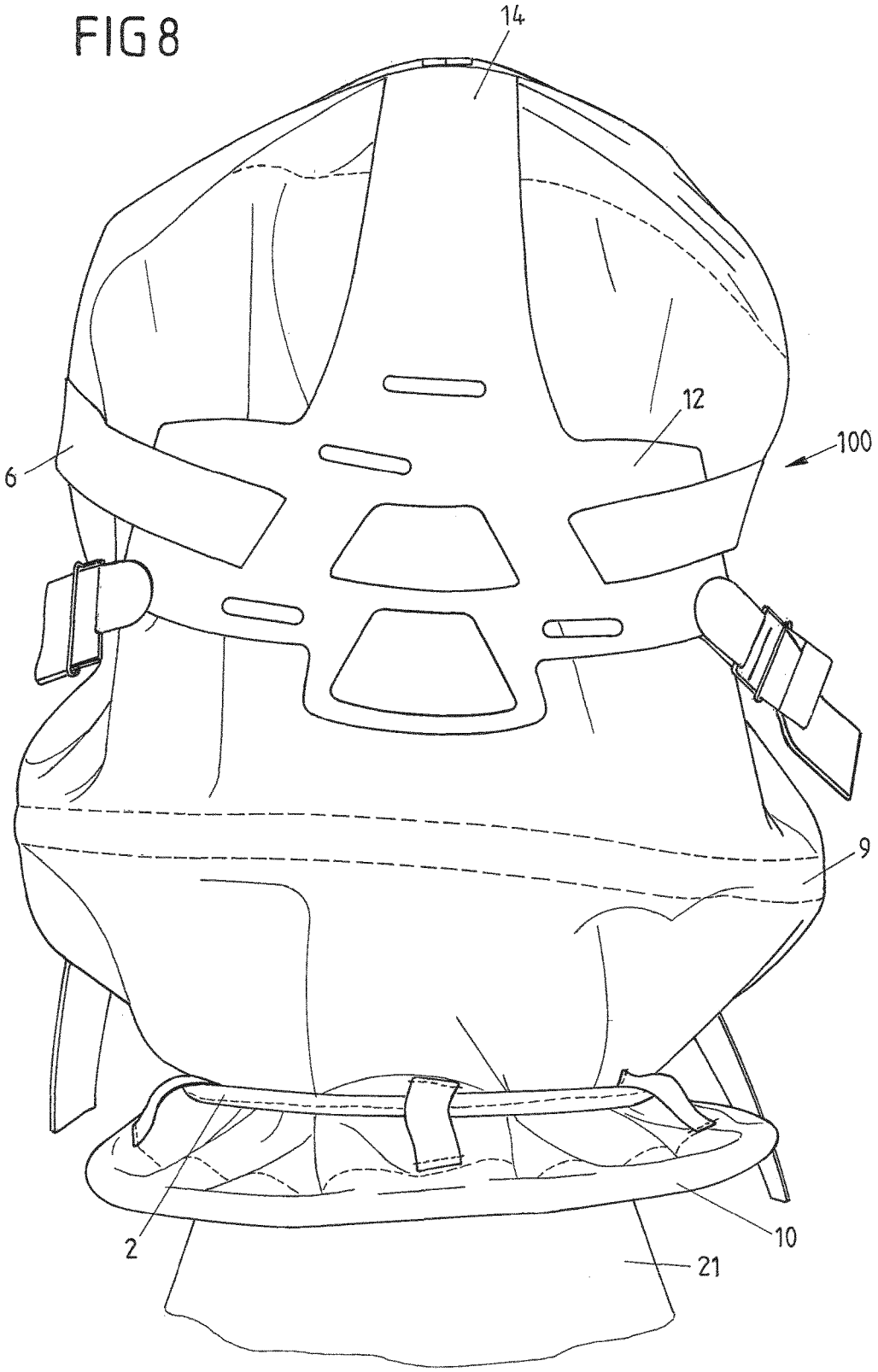
FIG. 8 illustrates a rear view of the example embodiment according to FIG. 1.

For a safe attachment of the protective hood 100 to a person's head 20, a securing mechanism such as fastening device 6 is set up on the outside of the protective hood 100. The fastening device 6 here has a headband arrangement with several bands. A set end of a band is set up in an area of the lower jaw of the person, and another end is set up in the area of the forehead, meeting on the upper edge of the viewing window 5. One arrangement of the head banding on the backside of the protective hood 100 is illustrated in FIG. 8.

The attachment device 6 in the illustrated embodiment has a stiffener 14 on the upper side, which may be made out of thin plastic elements. These stiffeners 14 are stiffer to bend than the bands, and as a result the textile material 4 is always somewhat stretched even when not in use. This stretching has the result that, when putting on the protective hood 100 (see FIG. 4), the person's head 20 is inserted into an already stretched opening, meaning that when the hood is put on the head 20, the flexible hood material 4 is not yet unfolded. It will be understood that the protective hood 100 can be attached to the person's head 20 by pulling on the straps.

In FIG. 1, one can also see two further stabilizers 9, 10, which are worked into the flexible hood material 4. The first stabilizer 9 is set up as an arc-shaped element, here in particular in a U-shape. Both sides of the first stabilizer 9 are set up for proper use on both sides of the head 20, with the crosswise area of the arc in the area of the rear of the head 20.

A second stabilizer 10 in this example embodiment is also set up as a U-shaped arc, which during proper use is set up in the same direction as the first stabilizer 9, though somewhat lower, meaning in the neck area 21. In this way the 2 U-shaped stabilizers 9, 10 lie over one another in essentially parallel planes, and so stretch the flexible material 4 such that the protective hood 100 can easily be put on (see, e.g., FIG. 3 and FIG. 4). The stabilizers 9, 10 in the illustrated example embodiment are sewed into pockets of the hood material 4 so that they themselves are not visible. It is recognizable that the textile material 4 is stretched by the stabilizers 9, 10.

In order to ensure that no harmful or contaminated gas, or only a very limited amount of such gases, and/or harmful particles can penetrate into the protective hood 100, sealing arrangement 2 is set up in the neck area so that sealing can take place. Sealing arrangement 2 is set up in the illustrated example embodiment as an elastic string set up between the two stabilizers 9, 10. The sealing arrangement 2 lies on the flexible hood material 4. In alternative embodiments, the sealing arrangement 2 may be worked into corresponding pockets of material of the hood material 4.

During use, the sealing arrangement 2 ties the flexible hood material 4 around the neck. In this way the area inside the protective hood 100 and above the sealing arrangement 2 is sealed off from the environment. Sealing off in this connection is to be understood in a way that the sealing is not hermetic; therefore, the sealing here is relative sealing. Rather the sealing is carried out because the sealing arrangement 2 exercises a throttling valve function. The air exhaled from the exhalation valve 3 expands the textile hood material 4 somewhat, whereby a portion of the air escapes that is under the, for example, string shaped sealing arrangement 2. In this way the exhalation air rinses the interior of the protective hood 100 and a slight positive pressure is set up against the environment. The positive pressure may lie in the area of 0.1 to 5 mbar, and in particular in the area between 0.5 to 3 mbar.

In the example embodiment in FIG. 1, the exhalation valve 3 of the breathing mask device 1 is set up inside this sealed off area. This means that the exhalation air gathers in the interior of the upper part of the breathing mask 100 and thereby creates a slight positive pressure (that is, toward the environment) in the area above the sealing arrangement 2. This positive pressure prevents having harmful substances from getting into the inner area of the protective hood 100, in particular in the area of the breathing mask device 2.

In FIG. 2, the example embodiment according to FIG. 1 is illustrated in a perspective view, and reference should be made to the description above. In this view as well it is recognizable that the sealing arrangement 2 creates a seal on the neck 21 between the two stabilizers 9, 10. The automatic lung machine 8 is connected with the breathing mask device 1 by a connector 7 in the interior of the breathing mask 100.

Figure 3:
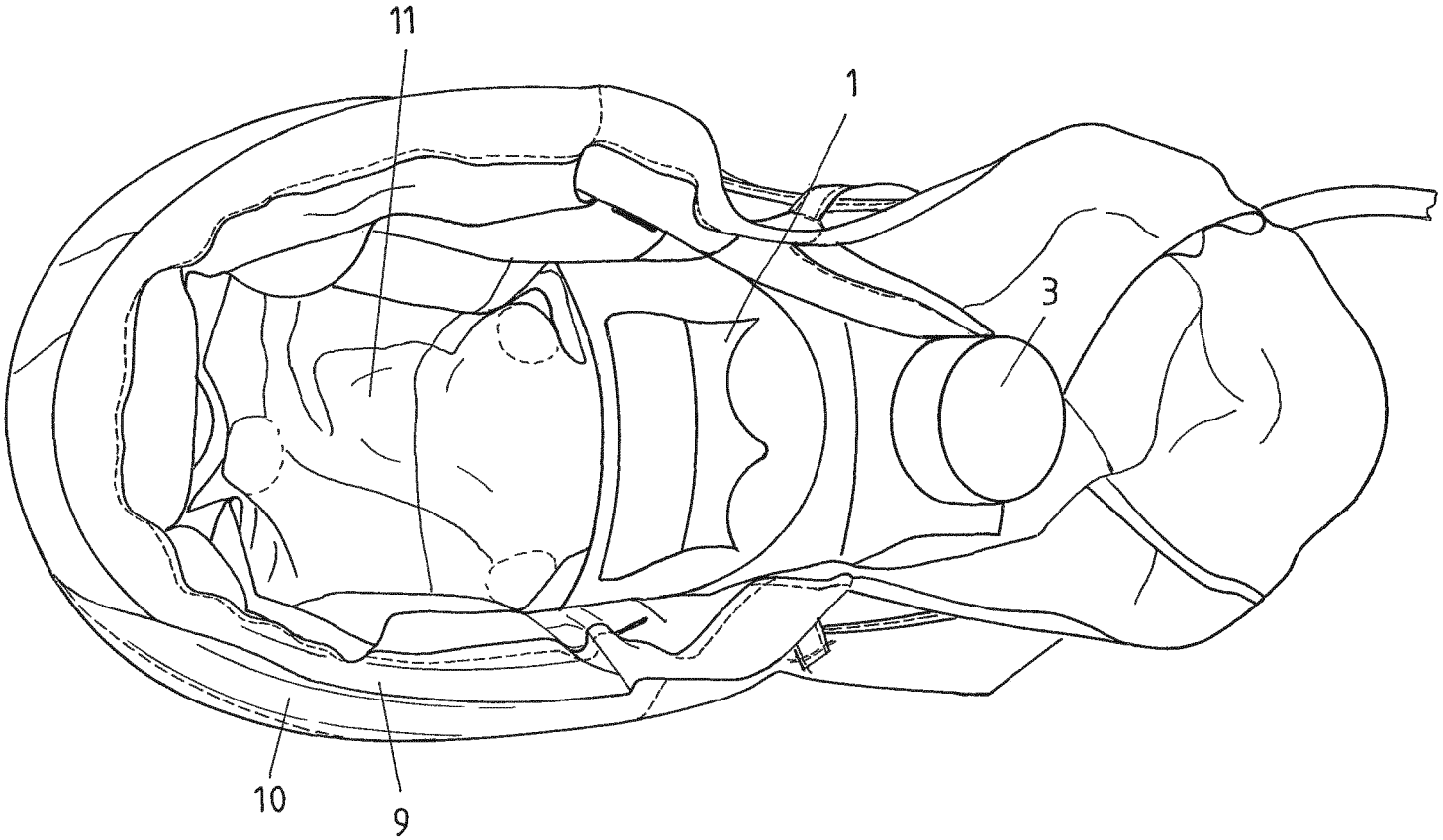
FIG. 3 illustrates a view of the underside of the example embodiment according to FIG. 1.

In FIG. 3, the example embodiment according to FIGS. 1 and 2 is illustrated from below, meaning that in particular the donning area 11 is illustrated, into which the user's head is inserted (see FIG. 4). In FIG. 3, on the left the arc-shaped (here U-shaped) stabilizers 9, 10 are illustrated open to the right, whereby the first stabilizer 9 is partially concealed because of this view. The stabilizers 9, 10 hold the donning area 11 open on at least three sides.

A portion of the breathing mask device 1 with the exhalation valve 3 is illustrated in the right half of the protective hood 100 in FIG. 3. The exhalation valve 3 during proper use (see e.g., FIG. 1 or FIG. 2) is not visible on the outside. In this example embodiment, the exhalation valve 3 is set up underneath the viewing window 5 (with relation to setting up for operations according to FIG. 1) and underneath the connector 7 for the automatic lung machine 8 (not visible in FIG. 3).

From the illustration in FIG. 3, it is also clear that the protective hood 100 can be folded relatively flat. It is for example possible to hold the stabilizers 9, 10 together by hook and loop fasteners (e.g., VELCRO closures) during storage. Before use, these VELCRO closures can be quickly opened.

Figure 4:
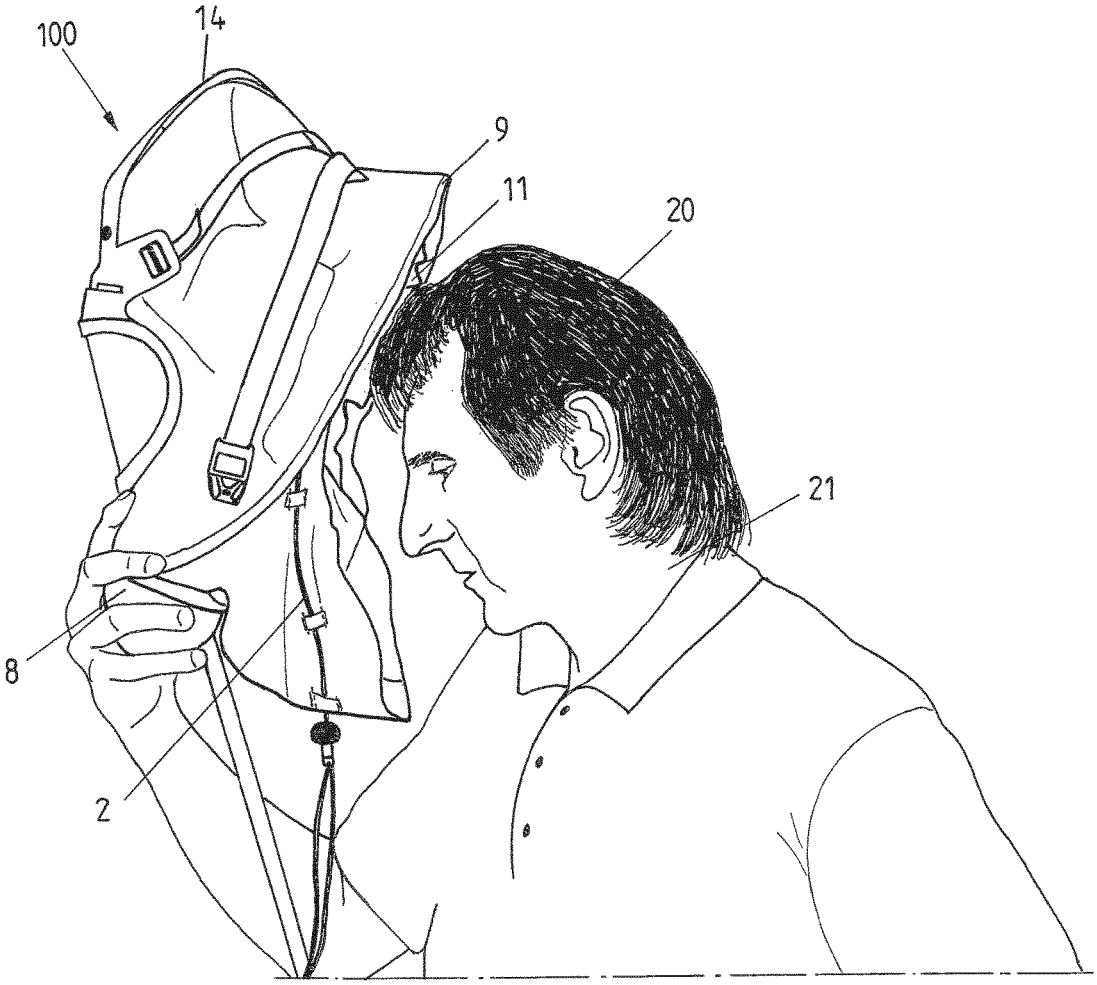
FIG. 4 illustrates a view of the example embodiment according to FIG. 1 before placing it on the head of a person.
Figure 5:
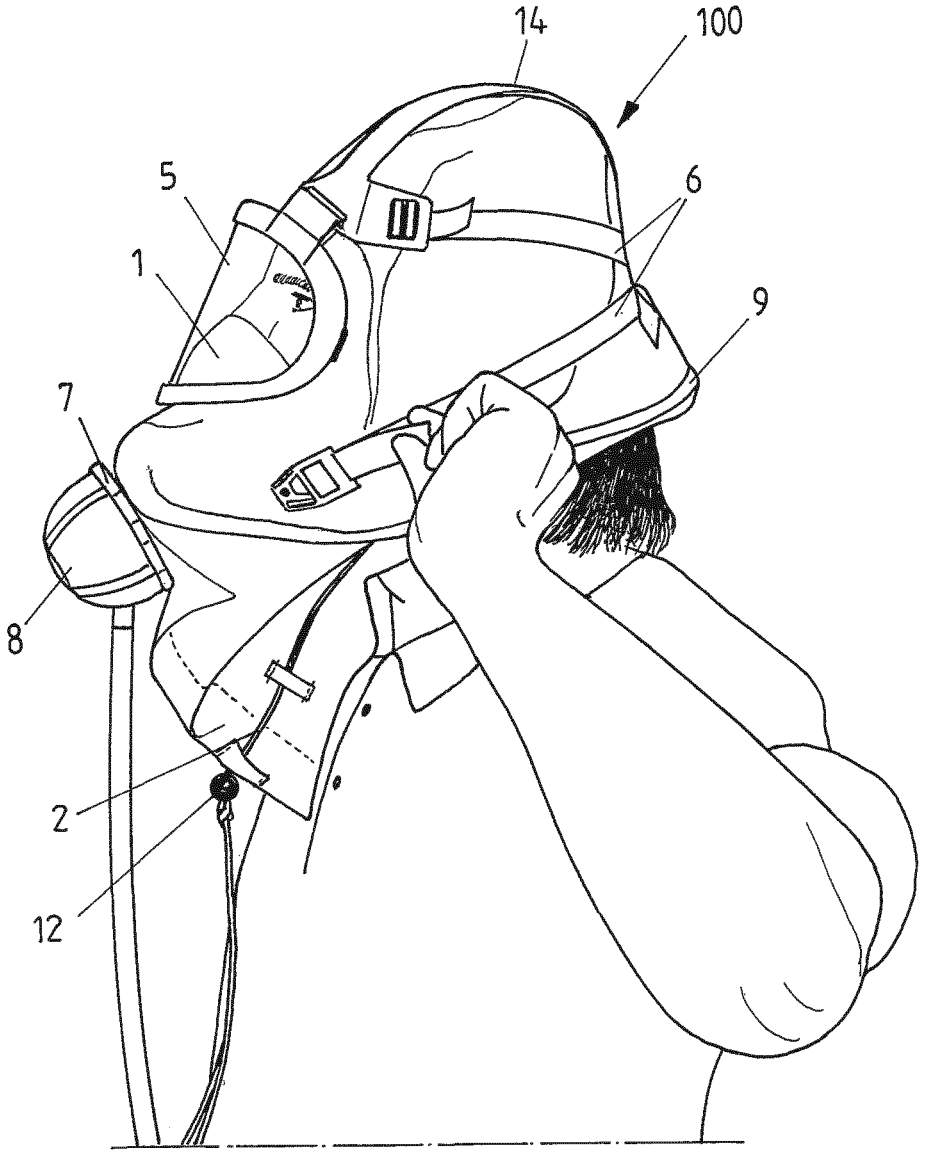
FIG. 5 illustrates a view of the example embodiment according to FIG. 1 after placing it on the head of a person.
Figure 6:
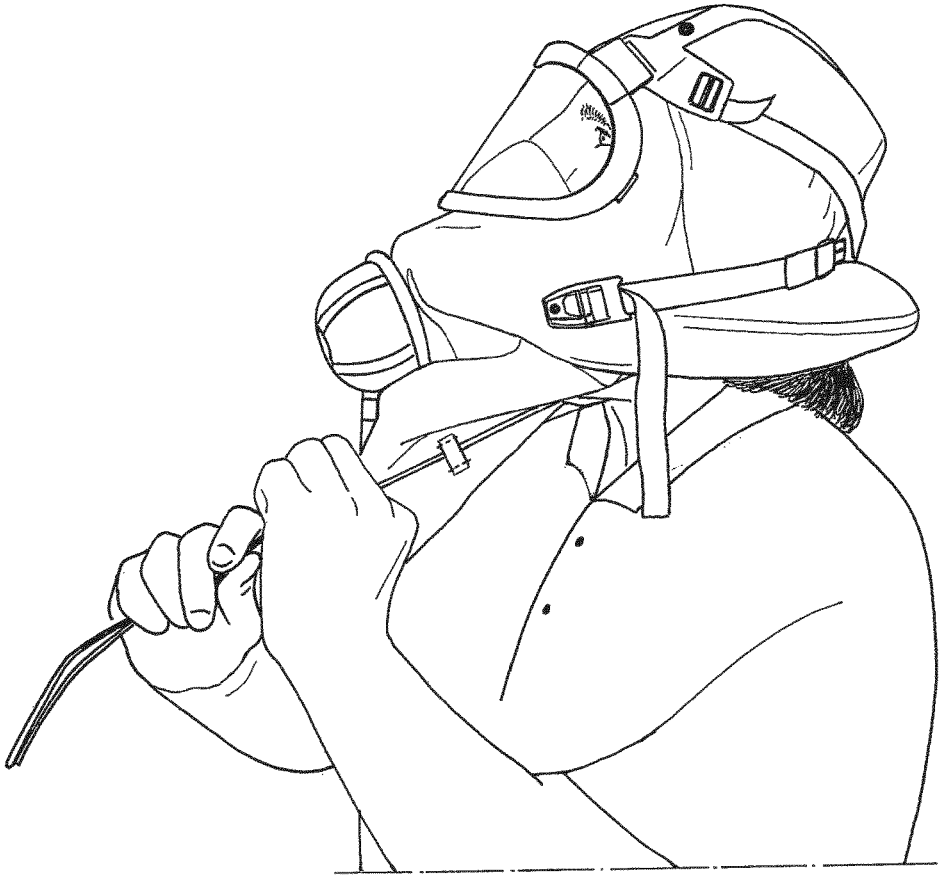
FIG. 6 illustrates a view of the example embodiment according to FIG. 1 after placing it on the head of a person and after fastening it.

Referring to FIG. 4 to FIG. 6, the putting on of one embodiment of the protective hood 100 (according to FIG. 1 to FIG. 3) is discussed in greater detail. In a first step (FIG. 4), the protective hood 100 with the donning area 11 showing downwards is held over a person's head 20. In FIG. 4, the protective hood 100 is connected to the automatic lung machine 8. The donning area 11 is held open by the stabilizers 9, 10 so that comfortable donning is made possible. The elastic string acts as a sealing arrangement 2 (in FIG. 4) has not yet been drawn tight.

In a second step (FIG. 5), the protective hood 100 is fastened to the person's head 20. For this purpose, at first the bands of the fastening device 6 are drawn tight. This may occur on both body sides simultaneously. The sealing arrangement 2 is not yet drawn tight in this step. Attention should be paid to the fact that the breathing mask device 1 on the inside of the protective hood 100 sits well sealed on the mouth and nose of the user, and an external supply of air is connected (not illustrated here).

In a third step (FIG. 6), sealing of the inside of the protective hood 100 is completed when the elastic string 2 of the sealing arrangement 2 is drawn tight and held in place by a clamping device 12 (see FIG. 5). After sealing, the interior of the protective hood 100 is regularly rinsed by the exhalation air coming out of the exhalation valve 3. In this way at least temporarily a positive pressure is created against the environment. In this way gaseous substances or dust from the environment are prevented from getting into the protective hood 100.

Figure 7:
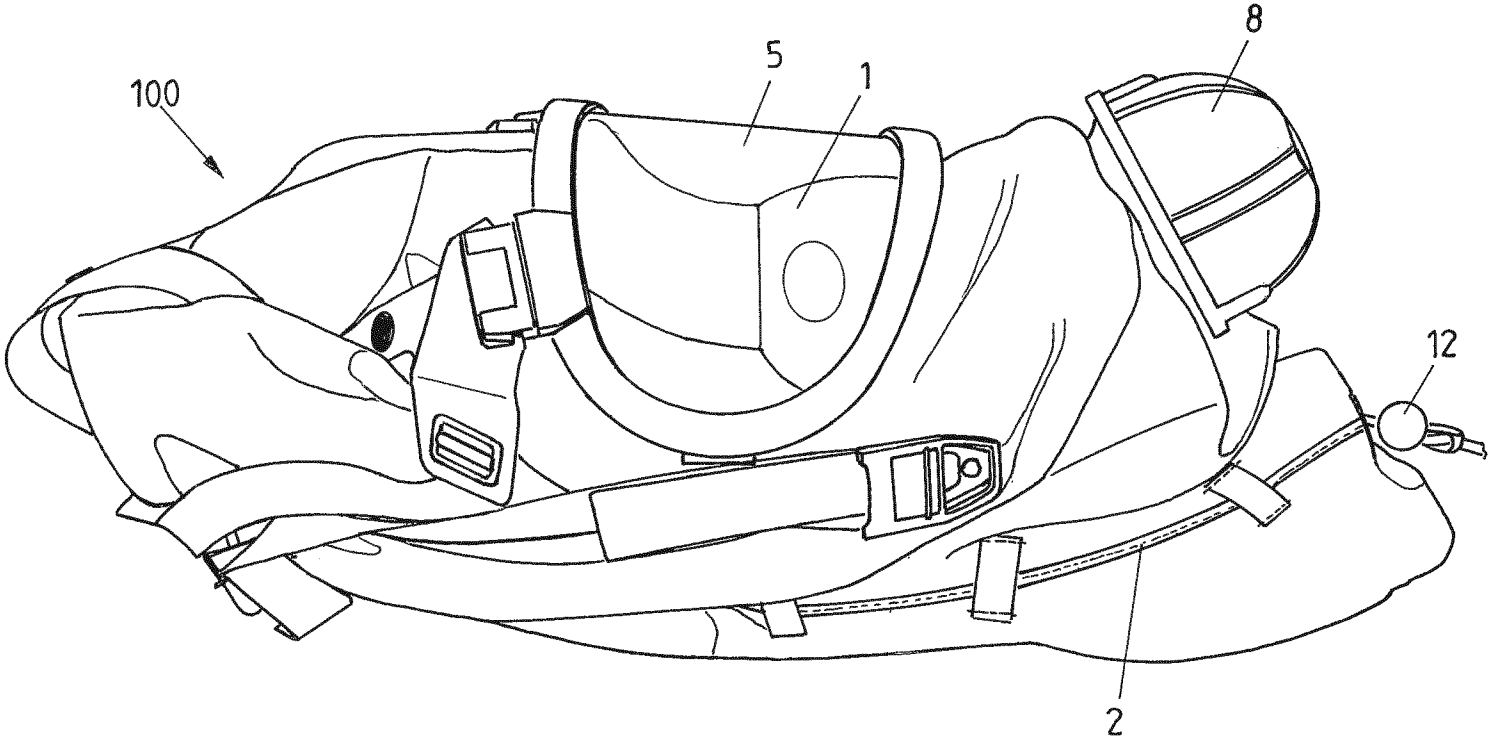
FIG. 7 illustrates a view of the example embodiment according to FIG. 1 in a folded position.

In FIG. 7, the previously illustrated example embodiment of the protective hood 100 is illustrated in a folded form with a view of the side. The protective hood 100 can be laid flat due to the flexible material 4. The arc-shaped stabilizers 9, 10 essentially lie parallel over one another and therefore take up very little vertical space.

FIG. 8 shows a rear view of an example embodiment of the protective hood 100. From this view, the arrangement of the stabilizers 9, 10 is readily apparent. The two stabilizers 9, 10 are set up over one another, whereby it is clear that the horizontal planes are essentially parallel. The elastic string of the sealing arrangement 2 is illustrated between the stabilizers 9, 10, whereby the sealing effect on the person's neck 21 is clearly visible. The bands of the fastening device 6 run together on the rear of the head 20 on a harness 13 made of flexible plastic. When the bands 6 are pulled tight on the left and right sides of the head 20 (see FIG. 5), the harness 13 distributes the pulling forces and makes sure of a secure seat of the protective hood 100 on the head 20.

Figure 9:
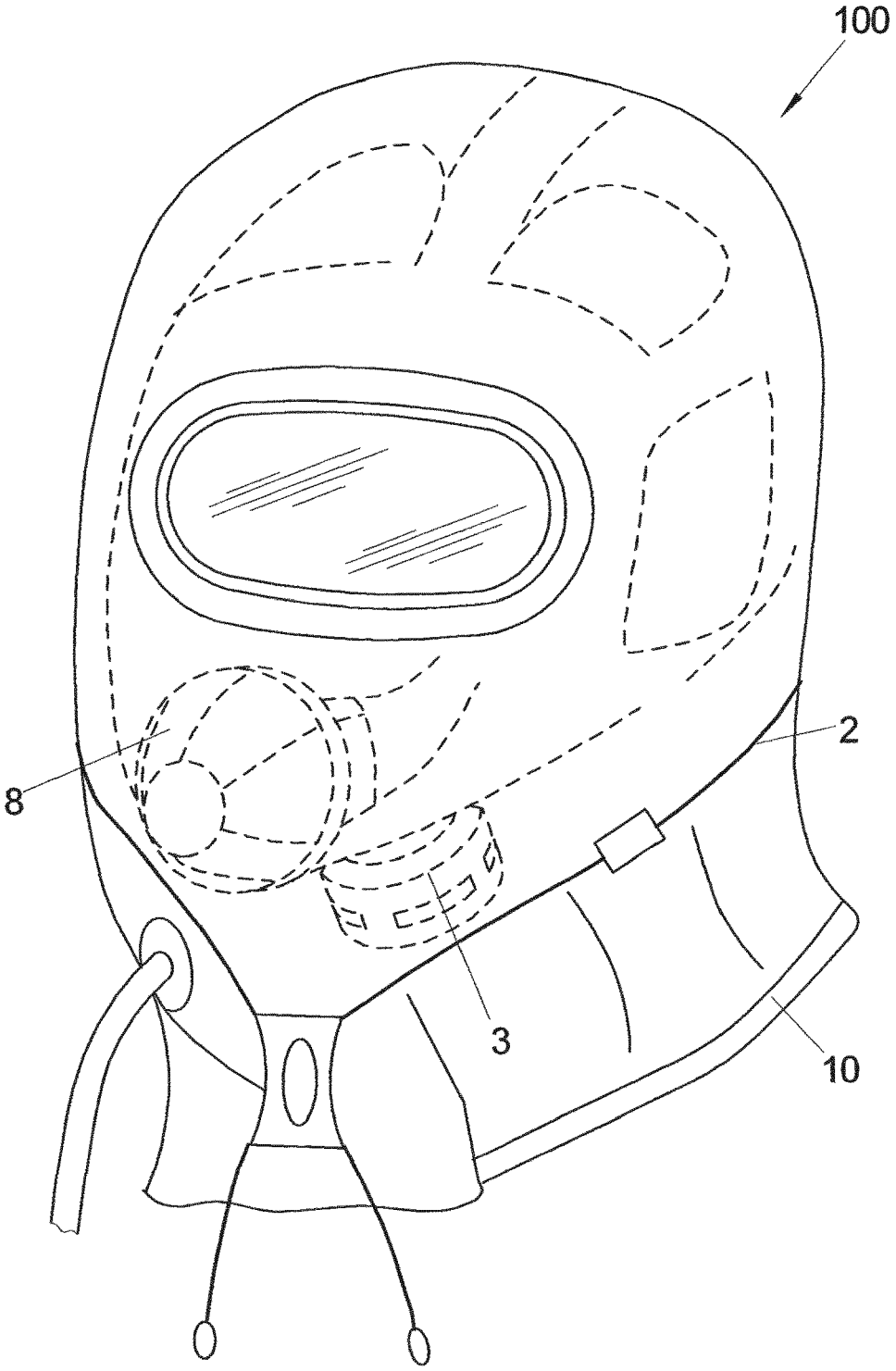
FIG. 9 illustrates a side view of a second example embodiment.

In the example embodiment according to FIG. 1 to FIG. 8, the exhalation valve 3 was arranged above the sealing arrangement 2, meaning that the exhalation air in the area above the sealing arrangement 2 may create a positive pressure. A second example embodiment is illustrated in FIG. 9, in which the exhalation valve 3 and the automatic lung machine 8 are set up on the inside of the protective hood 100 (both illustrated in FIG. 9 by dotted lines). Here only one arc-shaped stabilizer 10 is used, which holds open the donning area 11 of the protective hood 100. A sealing arrangement 2 is set up above this in the form of a pull string. The pull string can be stopped after being pulled together by a clamp. The exhalation valve 3 and the automatic lung machine 8 are set up above the sealing arrangement 2 and as a result the exhalation air also rinses the automatic lung machine 8. In an alternative embodiment, in place of the pull string or in addition to the pull string, an elastic element as part of sealing arrangement 2, such as a rubber pull, can be used to make the seal.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A protective hood, comprising:

a flexible hood material having a closed top portion and a neck portion;

a viewing window disposed within the flexible hood material;

a breathing inlet disposed in the flexible hood material and providing for breathing air to pass into an interior of the protective hood;

an exhalation valve disposed interior to the protective hood;

a sealing arrangement disposed at the neck portion of the flexible hood material; and a first stabilizer and a second stabilizer that provide form to the protective hood and stabilize the flexible hood material to keep a donning area clear, the first stabilizer and the second stabilizer attached to the flexible hood material, whereby the first stabilizer, when the protective hood is donned by a user, is located at substantially a back of the head of the user and the second stabilizer is located at substantially a back of the neck of the user, wherein the first stabilizer and the second stabilizer are essentially arc-shaped;

wherein at least a portion of expelled gas from the exhalation valve is released into an interior of the protective hood and rinses the interior of the protective hood, and wherein the sealing arrangement is disposed between the first stabilizer and the second stabilizer when the protective hood is donned by the user.

2. The protective hood according to claim 1, wherein the sealing arrangement is adjustable and when secured seals the interior of the protective hood from an outside environment.

3. The protective hood according to claim 2, wherein the sealing arrangement includes a pull string.

4. The protective hood according to claim 2, wherein, when the sealing arrangement adjusts to secure and seal the interior of the protective hood from an outside environment, a positive pressure builds up within the interior of the protective hood due to the expelled gas from the exhalation valve.

5. The protective hood according to claim 1, wherein the sealing arrangement acts as a throttling valve for the expelled gas from the exhalation valve.

6. The protective hood according to claim 1, further comprising a pressure demand regulator attached to the protective hood.

7. The protective hood according to claim 6, wherein the regulator is disposed within the interior of the protective hood.

8. The protective hood according to claim 1, wherein at least one of the first stabilizer and the second stabilizer is sewn into a pocket of the flexible hood material.

9. A breathing system, comprising:

a protective hood having a flexible hood material having a closed top portion and a neck portion;

a viewing window disposed within the flexible hood material;

a breathing inlet disposed in the flexible hood material and providing for breathing air to enter into an interior of the protective hood;

an exhalation valve disposed interior to the protective hood;

a sealing arrangement disposed at the neck portion of the flexible hood material;

a regulator attached to the protective hood; and a first stabilizer and a second stabilizer attached to the flexible hood material and wherein the first stabilizer and the second stabilizer provide form to the protective hood, whereby the first stabilizer, when the protective hood is donned by a user, is located at substantially a back of the head of the user and the second stabilizer is located at substantially a back of the neck of the user, wherein the first stabilizer and the second stabilizer are essentially arc-shaped;

wherein at least a portion of expelled gas from the regulator is released into an interior of the protective hood and rinses the interior of the protective hood, and wherein the sealing arrangement is disposed between the first stabilizer and the second stabilizer when the protective hood is donned by the user.

10. The breathing system according to claim 9, wherein an automatic lung machine is disposed within the protective hood.

11. The breathing system according to claim 9, wherein at least one of the first stabilizer and the second stabilizer is sewn into a pocket of the flexible hood material.

12. A method, comprising:

fixing a viewing window and a breathing inlet into a flexible hood material of a protective hood, the flexible hood material having a closed top portion and a neck portion;

providing an exhalation valve, wherein the exhalation valve is disposed within the protective hood such that gas expelled from the exhalation valve releases into an interior of the protective hood;

providing a sealing arrangement in the neck portion of the flexible hood material, the sealing arrangement being adjustable to allow sealing the interior of the protective hood off from an external environment; and providing a first stabilizer and a second stabilizer attached to the flexible hood material and wherein the first stabilizer and the second stabilizer provide form to the protective hood, whereby the first stabilizer, when the protective hood is donned by a user, is located at substantially a back of the head of the user and the second stabilizer is located at substantially a back of the neck of the user, wherein the first stabilizer and the second stabilizer are essentially arc-shaped, and wherein the sealing arrangement is disposed between the first stabilizer and the second stabilizer when the protective hood is donned by the user.

13. The method according to claim 12, wherein the sealing arrangement includes a pull string.

14. The method according to claim 13, wherein the sealing arrangement is elastic.

15. The method according to claim 13, wherein the sealing arrangement acts as a throttling valve for the expelled gas from the exhalation valve.

16. The method according to claim 12, further comprising attaching a regulator to the protective hood.

17. The method according to claim 16, wherein the regulator is attached to the protective hood such that the regulator is disposed within an interior of the protective hood.

18. The method according to claim 12, wherein at least one of the first stabilizer and the second stabilizer is sewn into a pocket of the flexible hood material.

* * * * *